US005797592A

United States Patent [19]

Machado

[11] Patent Number: 5,797,592

[45] Date of Patent: Aug. 25, 1998

[54] ROADSIDE ENERGY ABSORBING BARRIER WITH IMPROVED FENDER PANEL FASTENER

[75] Inventor: John V. Machado, Antelope, Calif.

[73] Assignee: Energy Absorption Systems, Inc., Chicago, Ill.

[21] Appl. No.: 876,645

[22] Filed: Jun. 16, 1997

[51] Int. Cl.[6] ..... E01F 15/00

[52] U.S. Cl. ..... 256/13.1; 404/6

[58] Field of Search ..... 256/13.1–9; 404/6, 404/9, 10

[56] References Cited

U.S. PATENT DOCUMENTS

| | | | |
|---|---|---|---|
| 1,847,025 | 2/1932 | Stockard | 256/13.1 |
| 2,047,992 | 7/1936 | Berk | 256/13.1 |
| 3,674,115 | 7/1972 | Young et al. . | |
| 3,845,936 | 11/1974 | Boedecker, Jr. et al. | 256/13.1 X |
| 3,982,734 | 9/1976 | Walker | 256/13.1 X |
| 4,407,484 | 10/1983 | Meinzer | 404/6 X |
| 4,452,431 | 6/1984 | Stephens et al. . | |
| 4,583,716 | 4/1986 | Stephens et al. | 256/13.1 |
| 5,660,496 | 8/1997 | Muller et al. | 404/6 |

FOREIGN PATENT DOCUMENTS

| | | | |
|---|---|---|---|
| 1749339 | 7/1992 | U.S.S.R. | 256/13.1 |

*Primary Examiner*—Harry C. Kim

*Attorney, Agent, or Firm*—Brinks Hofer Gilson & Lione

[57] ABSTRACT

A roadside energy absorbing barrier includes energy absorbing elements interposed between diaphragms, with fender panels mounted by hinges to the diaphragms. The fender panels define longitudinally extending slots, and a fastener is mounted between adjacent fender panels. This fastener includes a bolt passing through an enlarged washer, a slot in one fender panel and an adjacent fender panel. A nut is positioned on the bolt inwardly of the fender panels, and a coil spring is mounted on the bolt and reacts against the nut and the fender panels to bias the first fender panel toward the second fender panel while permitting a selected separation therebetween.

10 Claims, 3 Drawing Sheets

ROADSIDE ENERGY ABSORBING BARRIER WITH IMPROVED FENDER PANEL FASTENER

BACKGROUND OF THE INVENTION

This invention relates to roadside energy absorbing barriers of the type having an array of spaced diaphragms with energy absorbing elements interposed between the diaphragms and fender panels coupled to the diaphragms.

Roadside energy absorbing barriers of this type are commonly used alongside a roadway, and are designed to collapse axially in an impact to slow the impacting vehicle while minimizing personal injury. U.S. Pat. Nos. 3,674,115 and 4,452,431 describe two prior-art energy absorbing barriers of this type. Both of these patents are assigned to the assignee of the present invention.

In both of these prior-art energy absorbing barriers, the fender panels are mounted to the diaphragms by means of hinges, and springs are coupled between the forward portions of the fender panels and the diaphragms to bias the fender panels toward the centerline of the barrier. As shown in FIG. 4 of U.S. Pat. No. 3,674,115 and FIG. 6 of U.S. Pat. No. 4,452,431, adjacent fender panels move completely out of contact with one another during an impact.

The barrier shown in U.S. Pat. No. 4,452,431 includes wire elements 82 that are used to hold the fender panels inwardly prior to an impact. During an impact, these wire elements are completely disengaged from remaining portions of the barrier, and they must be replaced or re-bent after the impact if they are again to perform their original function.

SUMMARY OF THE INVENTION

The present invention is defined by the following claims, and nothing in this section should be taken as a limitation on those claims. The preferred embodiments described below provide a fastener in an energy absorbing barrier of the type described initially above. This fastener is mounted between a first fender panel and a second component of the barrier such as an adjacent fender panel. The fastener comprises a shank having enlarged portions at each end. The shank passes through the adjacent fender panels, and the fastener includes a spring that reacts against one of the enlarged portions of the shank to bias the two fender panels toward one another while permitting a selected separation therebetween.

DETAILED DESCRIPTION OF THE PRESENTLY PREFERRED EMBODIMENTS

Figure 1:
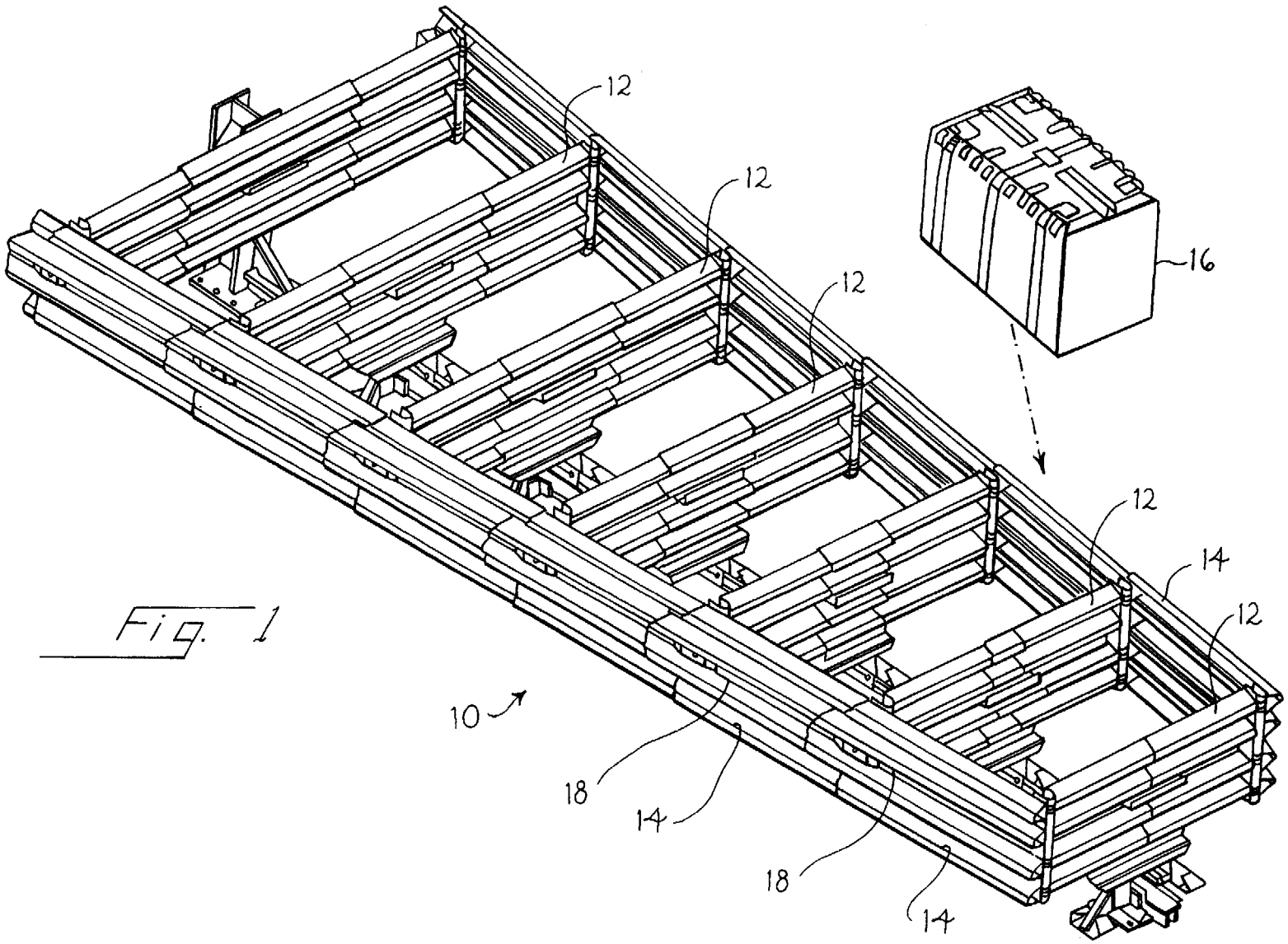
FIG. 1 is a perspective view of a roadside energy absorbing barrier that incorporates a preferred embodiment of this invention.
Figure 2:
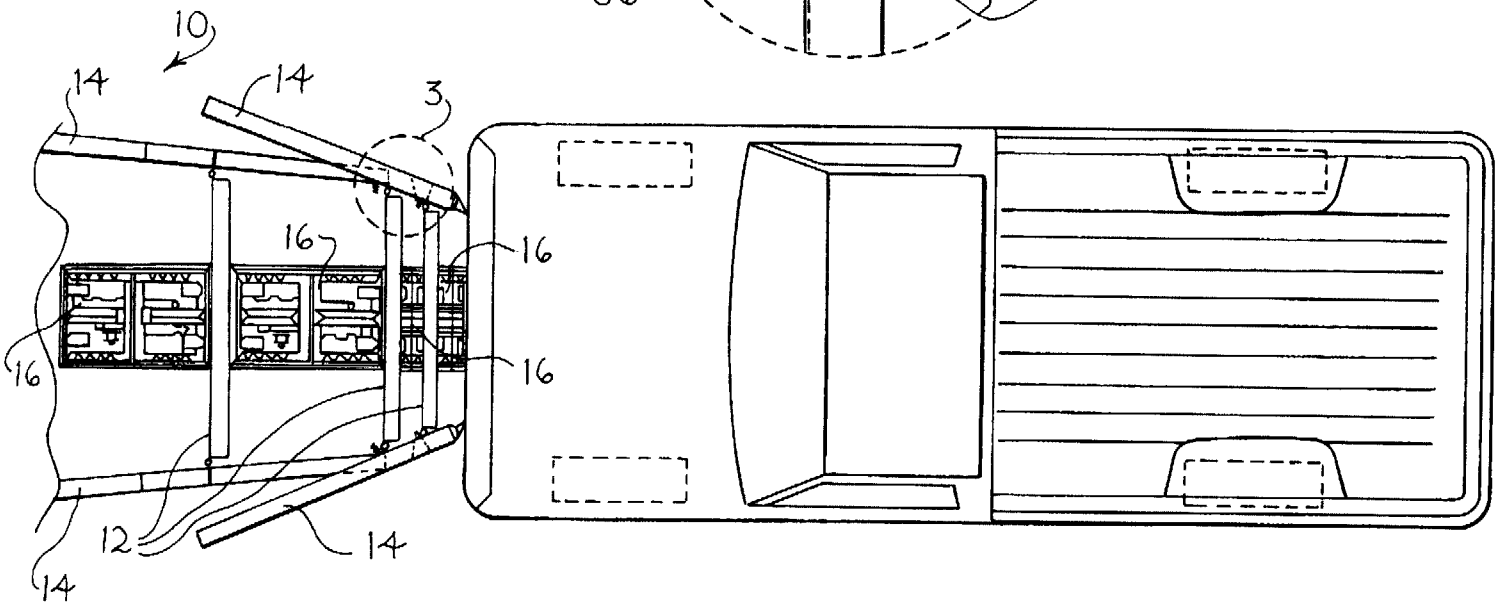
FIG. 2 is a top view of portions of the barrier of FIG. 1.

Turning now to the drawings, FIGS. 1 and 2 show two views of a barrier 10 that incorporates a preferred embodiment of this invention. This barrier 10 includes an axially extending array of diaphragms 12. Two fender panels 14 are connected at their forward ends to each of the diaphragms 12, and energy absorbing elements 16 are placed between the diaphragms 12. In FIG. 1, only one of the energy absorbing elements is shown (in exploded perspective), and the conventional nose piece has been removed for clarity.

The features of the barrier 10 described above, along with other features such as the manner in which the diaphragms 12 are supported, are preferably formed as described in the related U.S. patent application Ser. No. 08/558,109 filed Nov. 13, 1995, assigned to the assignee of the present invention.

As best shown in FIG. 1, the fender panels 14 define longitudinally extending slots 18, and the diaphragms 12 are of varying lengths. In general, the fender panels 14 are disposed at an angle with respect to the centerline of the barrier 10. In this preferred embodiment, that angle is between 3 and 6 degrees. Thus the fender panels 14 on one side of the barrier 10 are non-parallel with respect to the fender panels 14 on the other side of the barrier 10.

Figure 3:
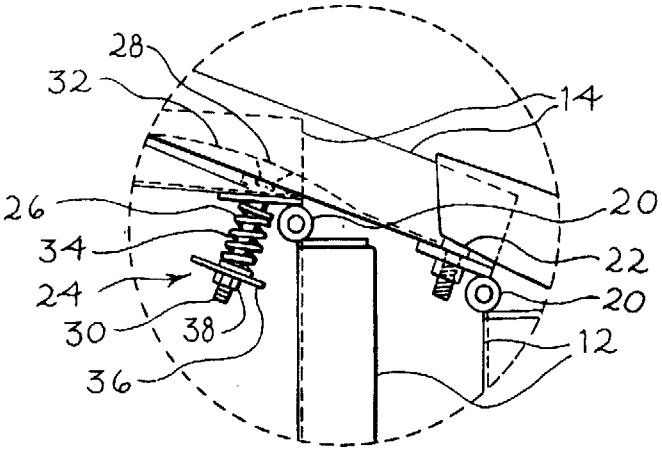
FIG. 3 is an enlarged view of the encircled region of FIG. 2.
Figure 4:
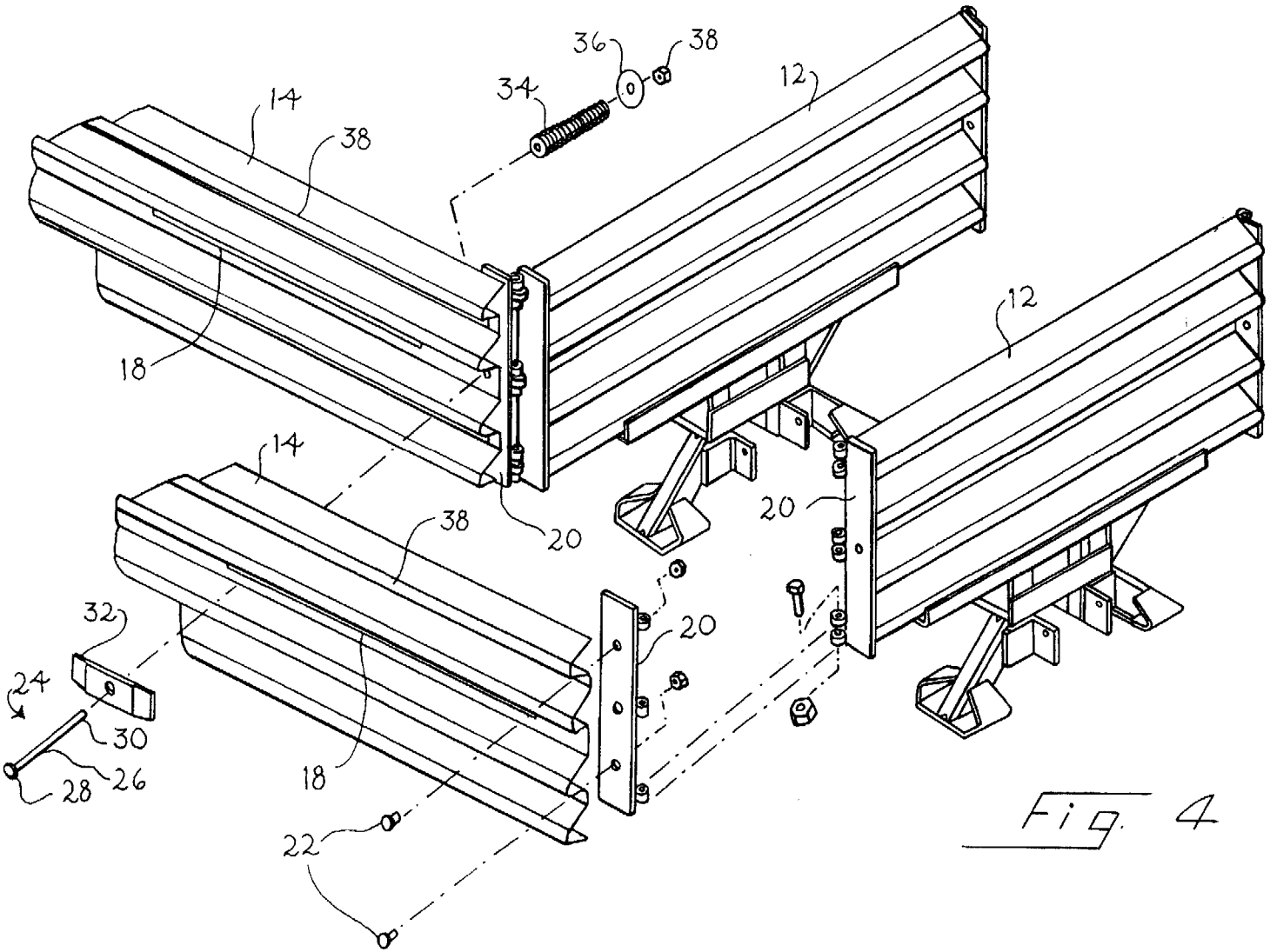
FIG. 4 is an exploded perspective view of selected parts of the barrier of FIGS. 1 through 3.

As best shown in FIGS. 3 and 4, each of the fender panels 14 is mounted by means of hinges 20 and fasteners 22 at its forward end to a respective one of the diaphragms 12. This allows the fender panels 14 to pivot outwardly during an impact. In this way, axial collapse of the barrier 10 allowed, without unnecessarily stressing or damaging the fender panels 14. When two adjacent diaphragms 12 are collapsed closely adjacent to one another in an impact, as shown in FIG. 2, the included angle between two adjacent fender panels 14 can be approximately 16°.

The fender panels 14 are also held in position by fasteners 24. The fasteners 24 in this embodiment include a bolt 26 having an enlarged head 28 and a threaded portion 30. The enlarged head 28 of the bolt 26 bears on an enlarged washer 32 such that the washer 32 and the bolt 26 are free to slide along the length of the slot 18. The inner end of the bolt 26 passes through the forward portion of a rearwardly adjacent fender panel 14 and the associated hinge 20.

Each fastener 24 also includes a helical coil compression spring 34 that bears at its outer end against the hinge 20 and its inner end against a washer 36 and a nut 38. The center portion of the bolt 26 can be considered a shank, and the head 24 and the nut 38 can be considered enlarged end portions of the shank.

Simply by way of example, the following details of construction have been found suitable in one application. These details of construction are, of course, not intended to limit the scope of the following claims. In this example, the spring 34 provides a compression stroke of 90 mm (3½ inches) and a spring rate of 46 kg/cm (256 pounds per inch). During assembly the nut 38 is used to pre-compress the spring 34 by about 25 mm (1 inch), such that a 63 mm (2½ inch) stroke remains. This pre-compression of the spring 34 provides a force in excess of 115 kg (250 pounds) tending to hold the ridges 38 of the fender panels 14 mechanically interlocked with one another. By way of example, the spring 34 can be formed of oil tempered, high carbon steel (ASTM A229) with the following dimensions:

Rectangular wire: 7.92 mm×4.78 mm (0.312 in×0.188 in);

Outside diameter: 38 mm (1.5 in);

Inside diameter: 19 mm (0.75 in);

Free length: 203 mm (8 in).

The bolt 26 may be formed of mechanically galvanized steel with the following dimensions:

Shaft: 16 mm (⅝ in) diameter, 11 UNC, 254 mm (10 in) length (ASTM-F835);

Length of Thread: 44 mm (1.75 in);

Head: flat socket head.

The hinges 20 can be formed of 22 mm (⅞ in) steel plates welded to the diaphragms 12 and bolted to the fender panels 14. The barrels of the hinges 20 can be formed of welded in place tubular steel having an outer diameter of 38 mm (1.5 in), a wall thickness of 9.5 mm (0.375 in) and a length of 21 mm (0.81 in). The hinge pins may be formed as conventional bolts passing through the barrels.

In the event of an axial collision as shown in FIG. 2, the energy absorbing elements 16 collapse, the diaphragms 12 move closely adjacent to one another, the fender panels 14 telescope over one another, and the fender panels 14 flare outwardly. This outward movement of the fender panels 14 about the pivot axes of the hinges 20 is accommodated by the fasteners 24 (FIG. 3). In particular, as a forward fender panel 14 pivots outwardly with respect to the respective rearward fender panel 14, the spring 34 compresses. Thus, pivoting movement is accommodated in the fender panels 14, while preserving a positive interconnection via the fastener 24 between adjacent fender panels 14. The limited separation between adjacent fender panels 14 allowed by the fasteners 24 substantially reduces loads on and permanent deformation of the fender panels 14 in an axial impact.

After the impact, the barrier 10 can readily be returned to its original position by pulling the forward diaphragm 12 outwardly. Often, the fender panels 14 are not permanently deformed, and they do not need to be repaired or replaced. The springs 34 automatically pull the fender panels 14 back into their original alignment as the barrier is pulled back to its original position. This reduces the work required to return the barrier 10 to service after an impact. Furthermore, the fasteners 24 preserve a positive interconnection between adjacent fender panels 14, which can contribute to system stability. Adjacent fender panels 14 act as guides tending to maintain the fender panels 14 in the desired orientation perpendicular to ground level. Nuisance impacts are therefore less of a problem, and problems associated with a vehicle, snagging the exposed end of a fender panel in a reverse direction collision are substantially prevented.

Of course, the present invention can be adapted to a wide variety of applications, and many of the elements described above can be modified as appropriate for the particular application. For example, the energy absorbing elements 16 can take any suitable form, including elements based on the combination of honeycomb material and foam (U.S. Pat. No. 4,352,484), on pneumatic cells (U.S. Pat. No. 4,674,911), on elastomeric units (U.S. Pat. Nos. 5,314,261 and 5,112,028), on foam (U.S. Pat. No. 5,192,157), on sheet metal panels (U.S. Pat. Nos. 5,199,755; 4,635,931; 4,711,481), on friction brakes (U.S. Pat. No. 5,022,782), on liquid modules (U.S. Pat. Nos. 3,674,115 and 3,503,060) as well as on vermiculite modules (U.S. Pat. Nos. 3,666,055 and 3,944,187). All of these patents are assigned to the assignee of the present invention.

Similarly, the diaphragms can take many forms, including frames or panels as described in U.S. Pat. Nos. 3,674,115, 3,982,734, and 4,452,431, also assigned to the assignee of the present invention. If desired, the diaphragms may be of the telescoping type rather than the inextendable type described above.

Fender panels can take many alternative forms including Thrie beams as disclosed in U.S. Pat. No. 3,944,187 and plywood as described in U.S. Pat. No. 4,452,431, both assigned to the assignee of the present invention.

The hinges are not limited to the forms described above. If desired, a single hinge pin can be used on each side of each diaphragm, and the hinges may be formed as living hinges that rely on bending material rather than pins and barrels.

The springs are not limited to coil springs, and other approaches such as elastomeric sleeves or Belleville washers can be used in particular applications.

The fastener is not limited to a threaded bolt, and many alternatives are possible. For example, the shank can be provided with cross bores and pins to provide the enlarged end portions, and end sleeves can be secured to the shank in various ways, including bayonet mounts. Shoulder bolts can be used if desired to insure consistent pre-tensioning of the springs.

The fasteners are not limited to use in the illustrated position, and if desired the fastener can extend between adjacent fender panels, without passing through hinges mounting the fender panels to the diaphragms 12. Furthermore, this invention is not limited to use with tapered barriers as shown in FIG. 1. Rather, the invention may also find application in parallel sided barriers of the type shown in U.S. Pat. No. 3,944,187. In this case the spring-loaded fastener reduces any tendency to stick or bind in an axial impact. The compression stroke of the spring can be reduced to a value such as 13 mm (½ inch), for example.

This detailed description describes only a few of the many forms that this invention can take. For this reason, it is only the following claims, including all equivalents, that should be taken as a definition of the scope of the invention.

I claim:

1. In a roadside energy absorbing barrier comprising a plurality of diaphragms arranged along a center line, a plurality of fender panels coupled to the diaphragms, and a plurality of energy absorbing elements interposed between the diaphragms, wherein a first one of the fender panels comprises a slot, the improvement comprising:

a fastener mounted between the first fender panel and a second component of the barrier, said fastener comprising a shank extending through the slot and said second component, said shank comprising an enlarged portion at each end of the shank, said fastener further comprising a spring reacting against one of the enlarged portions of the shank to bias the first fender panel toward the second component while permitting a selected separation therebetween, said spring oriented to bias at least part of the first fender panel toward the center line.

2. The invention of claim 1 wherein the second component comprises a hinge secured to one of the diaphragms.

3. The invention of claim 1 wherein the second component comprises a second fender panel.

4. The invention of claim 3 the fender panels comprise ridges which interlock adjacent ones of the fender panels, and wherein the fastener maintains interlocked engagement between the first and second fender panels during collapse of the barrier.

5. The invention of claim 1 wherein the other of the enlarged portions of the shank bears against an enlarged washer that in turn bears against the first fender panel adjacent the slot.

6. The invention of claim 1 wherein the diaphragms progressively increase in length with increasing distance from a forward portion of the barrier.

7. In a roadside energy absorbing barrier comprising a plurality of diaphragms, a plurality of fender panels coupled to the diaphragms, and a plurality of energy absorbing elements interposed between the diaphragms, wherein a first one of the fender panels comprises a slot, the improvement comprising:

a fastener mounted between the first fender panel and a second component of the barrier, said fastener comprising a shank extending through the slot and said second component, said shank comprising an enlarged portion at each end of the shank, said fastener further comprising a spring reacting against one of the enlarged portions of the shank to bias the first fender panel toward the second component while permitting a selected separation therebetween;

wherein the second component comprises a hinge secured to one of the diaphragms:

wherein the spring comprises a coil spring reacting against the hinge.

8. In a roadside energy absorbing barrier comprising a plurality of diaphragms, a plurality of fender panels coupled to the diaphragms, and a plurality of energy absorbing elements interposed between the diaphragms, wherein a first one of the fender panels comprises a slot, the improvement comprising:

a hinge mounted to a first one of the diaphragms;

a second fender panel mounted to the hinge;

an enlarged washer positioned at an outer side of the first fender panel adjacent the slot;

a bolt passing through the washer, the slot and the second fender panel;

a nut mounted on the bolt inwardly of the second fender panel; and a spring mounted on the bolt and reacting against the second fender panel and the nut to bias the first fender panel toward the second fender panel while permitting a selected separation therebetween.

9. The invention of claim 8 wherein the bolt additionally passes through the hinge, and wherein the spring reacts against the second fender panel via the hinge.

10. The invention of claim 8 wherein the diaphragms progressively increase in length with increasing distance from a forward portion of the barrier.

* * * * *

UNITED STATES PATENT AND TRADEMARK OFFICE

CERTIFICATE OF CORRECTION

PATENT NO. : 5,797,592

DATED : August 25, 1998

INVENTOR(S) : John V. Machado

It is certified that error appears in the above-identified patent and that said Letters Patent is hereby corrected as shown below:

In the Claims

In Claim 4, line 1, after "3" please insert --wherein--.

Signed and Sealed this

Sixth Day of February, 2001

*Attest:*

*Attesting Officer*

Q. TODD DICKINSON

*Director of Patents and Trademarks*